US006283584B1

(12) United States Patent
Powers et al.

(10) Patent No.: US 6,283,584 B1
(45) Date of Patent: Sep. 4, 2001

(54) INK JET FLOW DISTRIBUTION SYSTEM FOR INK JET PRINTER

(75) Inventors: James Harold Powers, Lexington; Matthew Joe Russell, Stamping Ground; Kent Lee Ubellacker, Georgetown, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/551,813

(22) Filed: Apr. 18, 2000

(51) Int. Cl.[7] ..... B41J 2/05; B41J 2/19
(52) U.S. Cl. ..... 347/65; 347/67; 347/92
(58) Field of Search ..... 347/63, 65, 67, 347/92–94, 47

(56) References Cited

U.S. PATENT DOCUMENTS

| | | | |
|---|---|---|---|
| 3,549,733 | 12/1970 | Caddell | 264/400 |
| 4,044,222 | 8/1977 | Kestenbaum | 219/121.71 |
| 4,164,745 | 8/1979 | Cielo et al. | 347/61 |
| 4,216,477 | 8/1980 | Matsuda et al. | 417/413.3 |
| 4,258,468 | 3/1981 | Balde | 29/830 |
| 4,317,124 | 2/1982 | Shirato et al. | 347/67 |
| 4,426,253 | 1/1984 | Kreuz et al. | 216/83 |
| 4,472,238 | 9/1984 | Johnson | 216/18 |
| 4,508,749 | 4/1985 | Brannon et al. | 427/555 |
| 4,568,632 | 2/1986 | Blum et al. | 430/322 |
| 4,587,534 | 5/1986 | Saito et al. | 347/56 |
| 4,635,358 | 1/1987 | Fritz | 29/853 |
| 4,683,481 | 7/1987 | Johnson | 347/65 |
| 4,714,516 | 12/1987 | Eichelberger et al. | 216/62 |
| 4,827,328 | 5/1989 | Ozawa et al. | 361/765 |
| 4,829,319 | 5/1989 | Chan et al. | 347/47 |
| 4,882,595 | 11/1989 | Trueba et al. | 347/85 |
| 4,894,115 | 1/1990 | Eichelberger et al. | 134/1.1 |
| 4,940,881 | 7/1990 | Sheets | 219/121.69 |
| 4,959,199 | 9/1990 | Brewer | 422/300 |
| 4,967,208 | 10/1990 | Childers | 347/56 |
| 5,061,840 | 10/1991 | Portney et al. | 219/121.68 |
| 5,063,280 | 11/1991 | Inagawa et al. | 219/121.7 |
| 5,119,116 | 6/1992 | Yu | 347/65 |
| 5,198,834 | 3/1993 | Childers et al. | 347/65 |
| 5,208,604 | 5/1993 | Watanabe et al. | 347/47 |
| 5,229,785 | 7/1993 | Leban | 347/47 |
| 5,291,226 * | 3/1994 | Schantz et al. | 347/63 |

(List continued on next page.)

FOREIGN PATENT DOCUMENTS

| | | | |
|---|---|---|---|
| 0 309 146 A2 | 3/1989 | (EP) | B41J/3/04 |
| 0 471 157 A1 | 2/1992 | (EP) | B41J/2/16 |
| 0 627 318 A1 | 12/1994 | (EP) | B41J/2/175 |
| 0 720 035 A2 | 7/1996 | (EP) | G02B/13/08 |
| 0 761 448 A2 | 3/1997 | (EP) | B41J/2/16 |
| WO 92/16822 | 10/1992 | (WO) | G01L/25/00 |

*Primary Examiner*—John Barlow
*Assistant Examiner*—Juanila Stephens
(74) *Attorney, Agent, or Firm*—Luedeka, Neely & Graham

(57) ABSTRACT

The invention provides a flow feature structure for an ink jet printer. The structure includes a polymeric nozzle plate having a nozzle plate thickness, the nozzle plate containing a plurality of ink chambers, each ink chamber containing a nozzle hole in fluid communication therewith, a plurality of ink channels each having a channel width and an ink channel inlet for providing ink flow from an ink supply region to one each of the ink chambers and an air bubble interrupter device having a width dimension perpendicular to a flow axis through the ink channel. The width dimension of the air bubble interrupter is from about 0.5 to about 1.2 times the ink channel width and the interrupter device is disposed adjacent each of the ink channels and spaced from the ink channel inlet a distance of from about 0.5 to about 1.2 times the ink channel width. Such a structure provides improvement in ink flow by reducing the size of air bubbles which may form or accumulate in the flow areas of the nozzle plate so that the air bubbles do not block or inhibit the flow of ink to the ink chambers or affect the ejection of ink from the nozzle holes.

17 Claims, 5 Drawing Sheets

U.S. PATENT DOCUMENTS

| | | | | |
|---|---|---|---|---|
| 5,305,018 | | 4/1994 | Schantz et al. | 347/47 |
| 5,312,517 | | 5/1994 | Ouki | 216/27 |
| 5,387,314 | | 2/1995 | Baughman et al. | 216/27 |
| 5,417,897 | | 5/1995 | Asakawa et al. | 264/400 |
| 5,463,413 | * | 10/1995 | Ho et al. | 347/65 |
| 5,467,115 | | 11/1995 | Childers | 347/47 |
| 5,467,118 | | 11/1995 | Gragg et al. | 347/87 |
| 5,484,507 | | 1/1996 | Ames | 216/2 |
| 5,495,665 | | 3/1996 | Carpenter et al. | 29/830 |
| 5,506,608 | | 4/1996 | Marler et al. | 347/18 |
| 5,818,478 | | 10/1998 | Gibson | 347/45 |
| 5,847,737 | * | 12/1998 | Kaufman et al. | 347/94 |
| 5,907,333 | | 5/1999 | Patil et al. | 347/20 |

* cited by examiner

INK JET FLOW DISTRIBUTION SYSTEM FOR INK JET PRINTER

FIELD OF THE INVENTION

The invention relates to ink jet nozzle plates having an improved ink flow distribution system for an ink jet printer and to methods for making nozzle plates for ink jet printers.

BACKGROUND

Ink jet technology continues to be improved in order to increase printing speed and print quality or resolution. One means for improving print speed and quality is to increase the number of nozzle holes in an ink jet printhead and to decrease the diameter of the nozzle holes. However, improvements in print speed and quality often result in operational problems not experienced with lower quality slower speed printers. Such higher resolution printers are more prone to blockages caused by air or debris trapped in critical ink flow areas of the printheads.

In an ink jet printer, ink is provided to the printhead from an ink cartridge or supply tank. The ink flows from the tank through a connecting conduit from the ink cartridge through an ink via in a semiconductor chip or around the edges of a semiconductor chip and into ink flow channels and an ink chamber. The ink chamber is situated in axial alignment with a corresponding nozzle hole and a heater resistor defined on the surface of the semiconductor chip. As electrical impulse energy is applied to the heater resistor, the ink adjacent the resistor is super heated and a vapor bubble forms which propels ink from the nozzle hole onto a print medium. By selective activation of a plurality of heater resistors on a printhead, a pattern of ink dots are applied to the print medium to form an image.

A critical aspect of the printing process is the controlled supply of ink to the printhead. Thermal ink jet printers use a plurality of resistance heating elements in the ink chambers to vaporize a component of the ink which then expands as a vapor bubble forcing ink out of the nozzle associated with the chamber. The pressure also forces ink out of the supply channel and may affect the ink in the ink supply region or ink via feeding supply channels of adjacent ink chambers.

Shortly after firing the heater element, the ink/vapor interface cools and the vapor bubble begins to contract and finally collapses onto the heater surface. As the bubble collapses, the chamber refills with ink from the ink via and ink supply region by capillary action. As the chamber refills, the ink forms a meniscus which undergoes an oscillatory motion. The oscillatory motion of the meniscus tends to pull a small amount of air into the ink chamber and under certain conditions. Additionally, the temperature of the ink increases as it flows from the reservoir into the heater chip then into the ink chambers. Since the solubility of air in the ink decreases with temperature, air in the ink tends to evolve into small bubbles. In either case, the air may be trapped in the chamber or accumulate in the channel or shelf area between the channel and ink via. Once this happens, the performance of the nozzle degrades severely. Trapped air also acts as a shock absorber which reduces the pumping action of the vapor bubble. Accumulation of air on the shelf adjacent the ink supply channels may affect more than one ink supply channel thereby affecting the ability to sufficiently refill the chambers with ink.

Until now, the primary concern with regard to ink flow distribution was debris which could block the ink supply channels. Accordingly, closely spaced structures for filtering ink feeding each ink channel were thought to be required. Such structures are described for example in U.S. Pat. No. 5,463,413 to Ho et al., U.S. Pat. No. 5,734,399 to Weber et al. and U.S. Pat. No. 5,847,737 to Kaufman et al. Conventional filter structures as described in the foregoing patents, while effective for debris do not solve all of the ink flow distribution problems and may have exacerbated other problems, such as air-related problems.

There is a need therefore for improved nozzle plate structures which provide effective ink flow distribution without degrading ink flow due to debris or air entrapment.

SUMMARY OF THE INVENTION

With regard to the above and other objects and advantages, the invention provides a flow feature structure for an ink jet printer. In a preferred embodiment, the structure includes a polymeric nozzle plate having a nozzle plate thickness, the nozzle plate containing a plurality of ink chambers, each ink chamber containing a nozzle hole in fluid communication therewith, a plurality of ink channels each having a channel width and an ink channel inlet for providing ink flow from an ink supply region to one each of the ink chambers. An air bubble interrupter device having a width dimension perpendicular to a flow axis through the ink channel is provided to reduce the size of air bubbles which may form or accumulate in the ink supply region. The width dimension of the interrupter is from about 0.5 to about 1.2 times the ink channel width and is disposed adjacent each of the ink channels and spaced from the ink channel inlet a distance of from about 0.5 to about 1.2 times the ink channel width.

In another aspect the invention provides an ink jet printhead including a semiconductor substrate containing a plurality of heater resistors. A nozzle plate is attached to the semiconductor substrate using an adhesive. The nozzle plate has a thickness for containing ink flow features therein for use in the absence of a separate thick film layer, the flow features including a plurality of ink chambers, each ink chamber containing a nozzle hole in fluid communication therewith, a plurality of ink channels each having a channel width and an ink channel inlet for providing ink flow from an ink supply region to one each of the ink chambers and an air bubble interrupter device having a width dimension perpendicular to a flow axis through the ink channel, the width dimension being from about 0.5 to about 1.2 times the ink channel width. The interrupter device is disposed adjacent each of the ink channels and spaced from the ink channel inlet a distance of from about 0.5 to about 1.2 times the ink channel width and is provided to reduce the size of air bubbles which may form or accumulate in the ink supply region of the printhead.

In yet another aspect, the invention provides a method for improving ink jet printing. The method includes laser ablating a polymeric material having a thickness sufficient to provide a nozzle plate for an ink jet printhead containing a plurality of nozzle holes, ink chambers and ink flow channels therein. An air bubble breaker is also laser ablated in the polymeric material adjacent each inlet of each ink flow channel leading to an ink chamber associated with a nozzle hole in the nozzle plate, the bubble breaker having dimensions and being spaced from the inlets of the ink flow channels a distance sufficient to substantially reduce the size of air bubbles which may form or accumulate in ink supply regions of the nozzle plate to a size sufficient to urge the air bubbles away from the ink flow channel inlets. The polymeric material is attached to a semiconductor substrate to provide an ink jet printhead having improved ink flow performance.

The apparatus and methods of the invention provide improved ink jet nozzle plates and printheads which reduce problems associated with ink flow to the ink chambers caused by air bubble formation in the ink supply areas of the printhead. Despite the reduction in debris filtering ability of the nozzle plate structure due to number, spacing and dimensions of the air bubble interrupter devices, misfiring due to ink flow blockage is noticeably reduced over conventional printhead designs containing such filtering structures. Furthermore, the nozzle plates and printheads according to the invention promote the flow of air bubbles out of the ink flow regions of the printhead more readily in the absence of conventional filter elements in the ink flow regions of the printhead.

BRIEF DESCRIPTION OF THE DRAWINGS:

Further advantages of the invention will become apparent by reference to the detailed description when considered in conjunction with the figures, which are not to scale, wherein like reference numbers indicate like elements through the several views, and wherein.

DETAILED DESCRIPTION OF THE PREFERRED EMBODIMENTS

Figure 1:
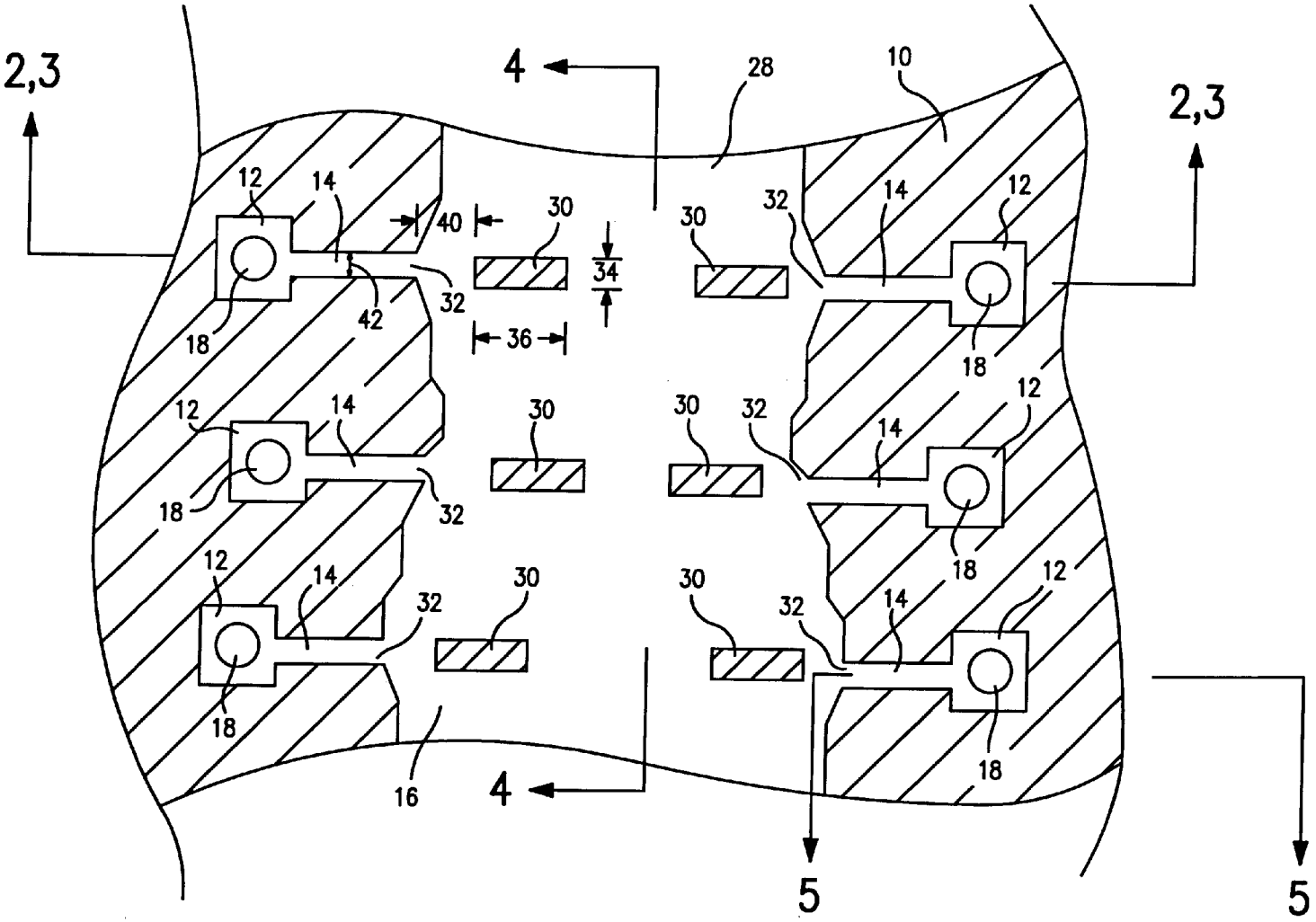
FIG. 1 is a plan view of a portion of a nozzle plate according to the invention as viewed from an ink flow side of the nozzle plate.

The invention provides improved nozzle plates for ink jet printers and methods and apparatus for making the nozzle plates. In particular, the invention provides a nozzle plate made from a polymeric material selected from the group consisting of polyimide polymers, polyester polymers, polymethyl methacrylate polymers, polycarbonate polymers and homopolymers, copolymers and terpolymers as well as blends of two or more of the foregoing, preferably polyimide polymers, which has a thickness sufficient to contain ink chambers, ink supply channels for feeding the ink chambers and nozzles holes associated with the ink chambers. It is preferred that the polymeric material have a thickness of about 10 to about 300 microns, preferably a thickness of about 10 to about 250 microns, most preferably a thickness of about 20 to about 80 microns and including all ranges subsumed therein. For the purpose of simplifying the description, the ink chambers and supply channels may be referred to collectively as the "flow features" of the nozzle plates.

Each nozzle plate contains a plurality of ink supply channels, ink chambers and nozzles holes which are positioned in the polymeric material so that the nozzle holes are associated with an ink propulsion device. Upon activation of the ink propulsion device a droplet of ink is expelled from the ink chamber through the nozzle hole to a print media. Sequencing one or more ink chambers in rapid succession provides a plurality of ink dots on the media which when combined with one another in a predefined pattern produce a visible image.

The nozzle plates may be formed in a continuous or semi-continuous process by laser machining a polymeric material which is provided as a continuous elongate strip or film. To aid in handling and providing for positive transport of the elongate strip of polymeric material through the manufacturing steps, sprocket holes or apertures are provided in the strip along one or both sides thereof.

The strip of material in which the nozzle plate is formed is conventionally provided on a reel. Several manufacturers, such as UBE of Japan and E.I. DuPont de Nemours & Co. of Wilmington, Delaware, commercially supply materials suitable for use in manufacturing the nozzle plates, under the trademarks of UPILEX or KAPTON, respectively. The preferred material for use in making nozzle plates is a polyimide tape containing an adhesive layer on one surface thereof.

The adhesive layer is preferably any B-stageable material. Examples of suitable B-stageable materials are thermal cure resins which include phenolic resins, resorcinol resins, urea resins, epoxy resins, ethylene-urea resins, furane resins, polyurethanes, and silicon containing resins. Thermoplastic or hot melt materials which may be used as an adhesive include ethylene-vinyl acetate, ethylene ethylacrylate, polypropylene, polystyrene, polyamides, polyesters and polyurethanes. The adhesive layer is typically about 1 to about 100 microns in thickness, preferably about 1 to about 50 microns in thickness and most preferably about 5 to about 30 microns in thickness. In the most preferred embodiment, the adhesive layer 24 is a phenolic butyral adhesive such as that used in the laminate RFLEX R1100 or RFLEX R1000, commercially available from Rogers of Chandler, Arizona.

During manufacture of the flow features of the nozzle plate, the adhesive layer is preferably coated with a sacrificial layer, preferably a water soluble polymer such as polyvinyl alcohol which remains on the adhesive layer until the laser ablation of the flow features in the nozzle plate is substantially complete. Commercially available polyvinyl alcohol materials which may be used as the sacrificial layer include AIRVOL 165, available from Air Products Inc. of Allentown, Pennsylvania, EMS1146 from Emulsitone Inc. of Whippany, New Jersey, and various polyvinyl alcohol resins from Aldrich Chemical Company of Milwaukee, Wisconsin. The sacrificial layer is preferably at least about 1 micron in thickness and is coated onto the adhesive layer which is on the polymeric film.

Methods such as extrusion, roll coating, brushing, blade coating, spraying, dipping, and other techniques known to the coatings industry may be used to coat the polymeric material with the adhesive and sacrificial layer. After machining the polymeric material to form the flow features therein, the sacrificial layer is be removed by dipping or spraying the polymeric material with a solvent such as water.

Figure 2:
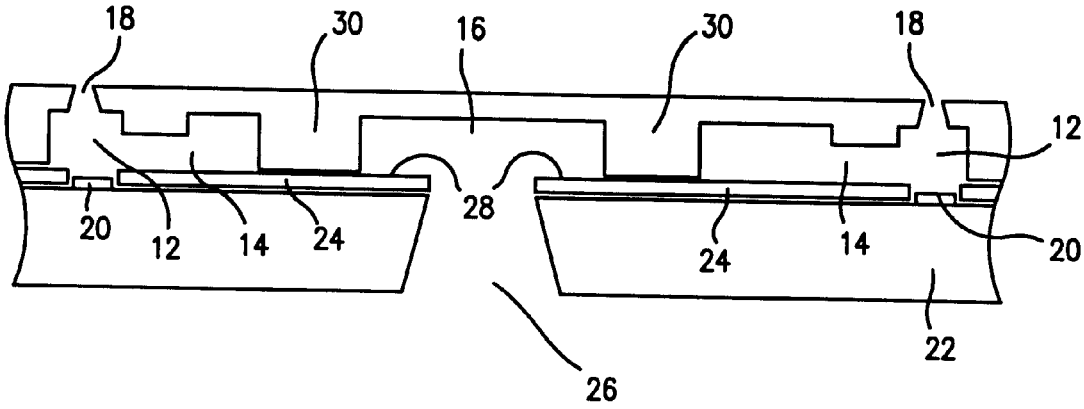
FIG. 2 is a cross-sectional view of a printhead according to the invention taken along A—A of FIG. 1.

Various aspects of the design of the nozzle plates and the impact of the design on their operation will be understood by referring to the drawings. Accordingly, FIG. 1 is a plan view of a portion of a nozzle plate 10 according to the invention as viewed from the ink flow side of the nozzle plate 10. The nozzle plate 10 includes a plurality of ink chambers 12 and ink channels 14 leading to the ink chambers 12 from an ink supply region 16 of the nozzle plate. Each of the ink chambers 12 contains a nozzle hole 18 for ejecting ink from the chamber 12 toward a print media upon activation of an ink propulsion device such as a heater resister 20 situated axially aligned with the nozzle hole 18 (FIG. 2). Ink propulsion devices may also include piezoelectric devices. The ink chambers 12, ink channels 14, nozzle holes 18 and ink supply region 16 are preferably made by the laser machining techniques which is described in more detail below.

The heater resistors 20 for each nozzle hole 18 are defined by depositing layers of conductive, resistive and insulative layers on the surface of a silicon semiconductor substrate 22 in a predefined pattern. Such deposition processes are well known and are not critical to the invention.

Figure 3:
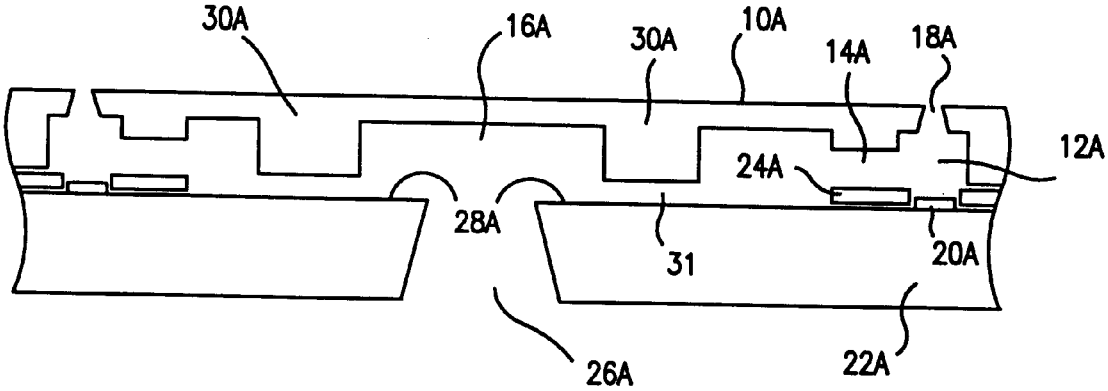
FIG. 3 is a cross-sectional view of an alternative printhead according to the invention taken along A—A of FIG. 1.

Prior to attaching the nozzle plate 10 to the semiconductor substrate 22, it is preferred to coat the substrate with a thin layer of photocurable epoxy resin 24 to enhance the adhesion between the nozzle plate 10 and the substrate 22 and to fill in topographical features on the surface of the semiconductor substrate 22. The photocurable epoxy resin 24 is spun onto the substrate 22, photocured in a pattern which defines areas for the heater resistors 20, electrical contacts therefor and an ink supply via 26 in the semiconductor substrate 22. In an alternative embodiment, epoxy resin 24A is also patterned to define the supply channels 14A, ink chambers 12A and ink supply region 16A as shown in FIG. 3. A preferred photocurable epoxy formulation comprises from about 50 to about 75 % by weight γ-butyrolactone, from about 10 to about 20% by weight polymethyl methacrylate-co-methacrylic acid, from about 10 to about 20% by weight difunctional epoxy resin such as EPON 1001F commercially available from Shell Chemical Company of Houston, Texas, from about 0.5 to about 3.0% by weight multifunctional epoxy resin such as DEN 431 commercially available from Dow Chemical Company of Midland Michigan, from about 2 to about 6% by weight photoinitiator such as CYRACURE UVI-6974 commercially available from Union Carbide Corporation of Danbury and from about 0.1 to about 1% by weight gamma glycidoxypropyltrimethoxy-silane.

Activating the heater resistor 20 superheats a thin layer of ink adjacent the surface of the heater resistor 20. As the thin layer of ink is heated, volatile components in the ink produce a vapor bubble. As the vapor bubble expands it forces a portion of ink out of the ink chamber 12 through the nozzle hole 18. The ink ejected from the ink chamber 12 strikes the surface of a print medium thereby marking the same with ink. Because the vapor bubble expands rapidly in all directions, it also forces ink out of the supply channel 14 and back toward the ink supply region 16. As shown in FIGS. 2 and 3, ink is provided to the ink supply region 16 by flow from an ink reservoir or ink cartridge through an ink via 26 or 26A in the semiconductor substrate 22 or 22A.

As the vapor bubble collapses after ink is expelled from the ink chamber 12, the chamber 12 refills with ink from the ink via 26 and ink supply region 16 by capillary action. Ink is drawn back into the supply channel 14 and ink chamber 12 from the ink supply region 16 by a combination of bubble collapse and capillary action in the supply channel 14. Once the ink chamber 12 has been refilled, it is again ready to expel ink from the nozzle hole 18. The time between when ink has been expelled from the ink chamber and when the ink chamber has been refilled is referred to as the "settling time."

As the chamber 12 refills with ink, the ink forms a meniscus which undergoes an oscillatory motion. The oscillatory motion of the meniscus tends to pull a small amount of air into the ink chamber 12 from the nozzle holes 18. Trapped air in the ink chambers 12 acts as a shock absorber which reduces the pumping action of the vapor bubble during ink ejection through the nozzle holes 18.

Additionally, in the process of forming vapor bubbles, waste heat from the heater resistors 20 raises the temperature of the printhead. Since the solubility of air in ink decreases with temperature increase, a rise in printhead temperature forces some air out of the ink. Some of the air forced out of the ink accumulates in the ink chambers 12, channels 14 and along the shelf area 28 on the semiconductor substrate 22 between the channels 14 and the ink via 26. The accumulation of air bubbles in the channels 14 and along the shelf area 28 inhibits the flow of ink from the ink via 26 into the ink chambers. 12.

An important feature of the invention is the provision of an air bubble interrupter device or air bubble breaker 30 adjacent an inlet 32 of each of the ink flow channels 14. The air bubble interrupter device 30 is dimensioned and spaced from the inlet 32 a predetermined amount effective to reduce the size of air bubbles which may accumulate on the shelf area 28 and effectively block ink flow into one or more ink supply channels 14.

The air bubble interrupter device 30 is preferably ablated in the polymeric material of the nozzle plate 10 so that it is formed integral with the nozzle plate 10.

Figure 4:
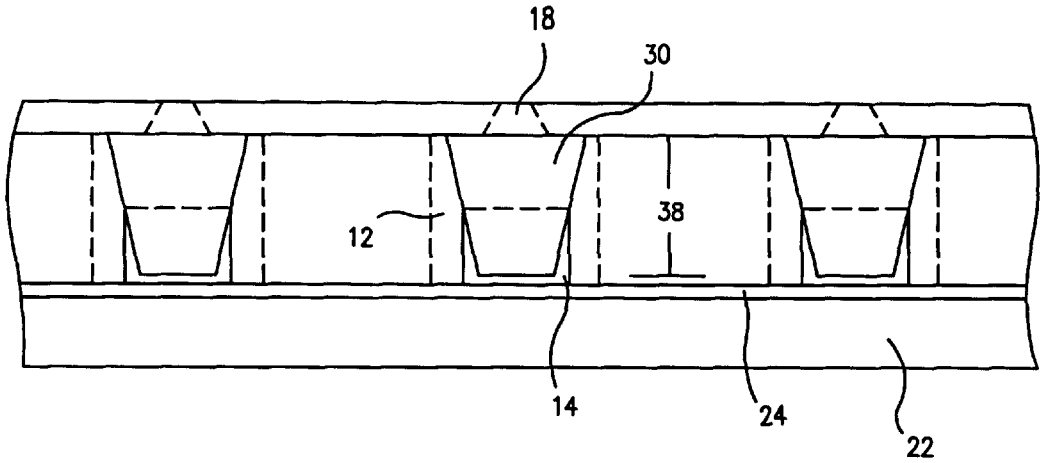
FIG. 4 is a cross-sectional view of a printhead according to the invention taken along B—B of FIG. 1.

Referring again to FIG. 1, the air bubble interrupter device 30 preferably has a width dimension 34 which ranges from about 5 to about 60 microns, a length dimension 36 which ranges from about 10 to about 80 microns and a height dimension 38 which ranges from about 5 to about 50 microns (FIG. 4). As shown in FIG. 4, the air bubble interrupter device 30 has a substantially trapezoidal shape. The air bubble interrupter device 30 is preferably spaced from the inlet 32 of the ink flow channels 14 a distance 40 which ranges from about 5 to about 30 microns. In terms of the nozzle plate 10 and flow features dimensions, the air bubble interrupter device preferably has a width 34 dimension ranging from about 0.5 to about 1.2 times an ink channel width 42 of the ink channel 14, a length dimension 36 which ranges from about 1 to about 3 times the ink channel width 42, a height dimension 38 which ranges from about 0.1 to about 0.8 times the overall thickness 44 of the nozzle plate material 10 (FIG. 5) and is spaced from the ink channel inlet 32 a distance 40 ranging from about 0.5 to about 1.2 times the ink channel width 42. It is particularly preferred that the air bubble interrupter device 30 have a height dimension 38 which is substantially equal to about 0.3 to about 0.6 times the thickness 44 of the nozzle plate 10.

The air bubble interrupter device 30 may be attached to or rest on the epoxy resin layer 24 as shown in FIG. 2, or, if the resin layer 24A is patterned as shown in FIG. 3, there will be a gap 31 between the air bubble interrupter device 30A and the shelf area 28A. It is not necessary for the air bubble interrupter device 30 to rest on or be attached to the resin layer 24 or surface of the semiconductor substrate 22A as the nozzle plate 10 has sufficient rigidity to resist sagging or deforming over the flow features of the nozzle plate.

Figure 5:
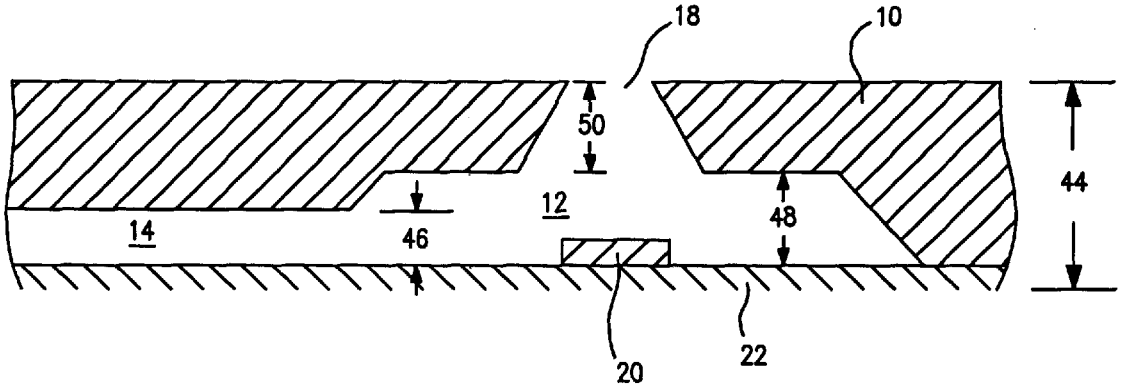
FIG. 5 is a cross-sectional view of an ink chamber and supply channel in accordance with the invention.

The nozzle plates 10 of the invention contain flow features which enable the ink chambers 12 and supply channels 14 to be independently designed to optimize printer performance and to reduce air and debris blockages of the supply channels 14 as well as decrease the settling time between ink chamber firings. FIG. 5 provides a cross-sectional view through a supply channel 14, ink chamber 12 and nozzle hole 18. The configuration and design of a nozzle plate 10 as shown in FIG. 5 enables the ink chamber 12 dimensions to be optimized independently of the supply channel 14. As shown in FIG. 5, the height 46 of the supply channel 14 is substantially less than the height 48 of the ink chamber 12, preferably from about 0.2 to about 0.8 times the height 48 of the ink chamber 12. However, it may be desirable for the height 48 of the ink chamber 12 to be substantially less than the height 46 of the supply channel 14. In such a case, the height 48 of the ink chamber 12 ranges from about 0.2 to about 0.8 times the height 46 of the supply channel 14. Accordingly, the thickness 50 of the polymeric material above the ink chamber 12 preferably ranges from about 5 to about 70 microns.

Figure 6:
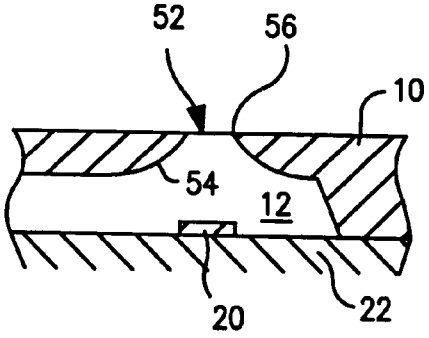
FIGS. 6 and 7 are cross sectional views of nozzle hole designs according to the invention.
Figure 7:
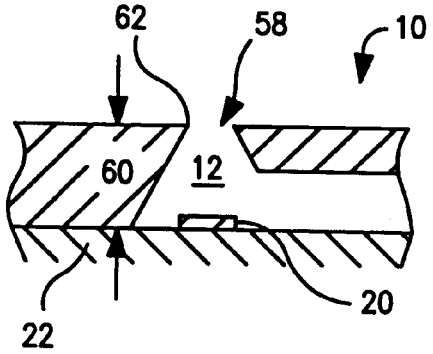

Various nozzle hole designs are illustrated in FIGS. 6 and 7 and may be used with any of the foregoing nozzle plates 10. As shown in FIG. 6, nozzle hole 52 may have a substantially bell shaped configuration with a wider portion 54 of the hole 52 facing the ink chamber 12 so that there is a smooth transition from the ink chamber 12 to an exit 56 of the nozzle hole 52

In FIG. 7, the nozzle hole 58 and ink chamber 12 have a truncated conical shape for an entire distance 60 between the semiconductor substrate 22 and an exit 62 of the nozzle hole 58. The conical shape of the nozzle hole 58 and ink chamber 12 reduces the trapping of air in the ink chamber 12 by eliminating the sharp boundary between the ink chamber 12 and the nozzle hole 58. The shape also provides better ink flow in the chamber 12 and out through the nozzle hole 58 by eliminating dead zones in the ink chamber 12 thereby decreasing the likelihood of air remaining in the ink chamber 12. The conical shape also reduces air ingestion by increasing meniscus damping of the oscillations caused by bubble formation and vapor bubble collapse in the ink chamber 12.

Various methods may be used to form the nozzle plates 10 of the invention.

Figure 8:
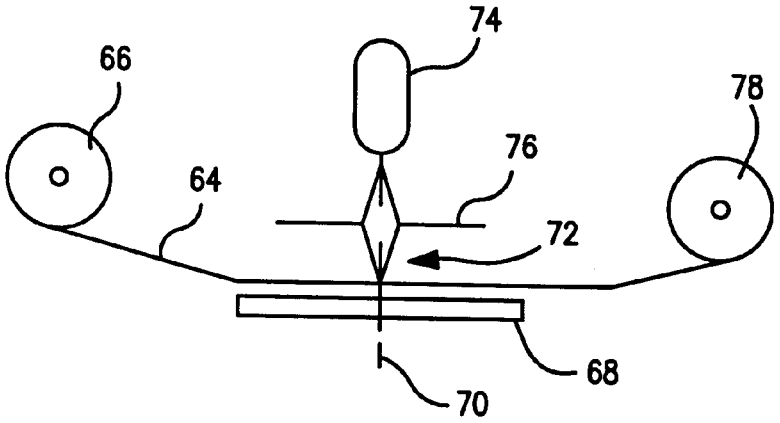
FIG. 8 is a schematic representation of a laser process for ablating a polymeric material to form nozzle plates according to the invention.

The methods may include the use of a single mask or multiple masks and methods for controlling the laser radiation energy impacted on the polymeric material. In order to produce the nozzle hole shapes illustrated in FIGS. 6 and 7, a defocusing technique is preferably used. In a particularly preferred defocusing technique, illustrated in FIG. 8, a polymeric material 64 to be ablated in the form of a film is unrolled from a supply reel 66 onto a platen 68. The platen 68 is movable in a vertical direction along an axis 70 of a laser beam 72 emitted from a laser source 74. A mask 76 containing the flow features to be formed in the polymeric material 64 is placed in the path of the laser beam 72 so that the features as described above are formed. After ablating the flow features in the polymeric material 64, the material is rewound on a product reel 78 for further processing.

Initially, the laser beam 72 is focused at a point which is plus or minus about 50 microns, preferably plus or minus about 30 microns and most preferably plus or minus about 10 microns within the top surface of the polymeric material 64. As the material 64 is ablated, the platen 68 is moved in a vertical direction toward the laser 74 along laser beam axis 70 in order to control the defocus of the beam 72.

By moving the platen 68 vertically, along the axis 70 of the laser beam 72 at the same time the laser 74 is being fired, the wall angle of the nozzle holes formed in the polymeric material 64 is gradually varied between smaller angles measured from the horizontal plane perpendicular to the laser beam axis 70 and larger hole diameters for large values of beam defocus to smaller hole diameters and larger angles measured from the horizontal plane perpendicular to the laser beam axis 70 for more focused laser beams. By altering the relationship between laser firings and platen movement, nozzle holes having bell shapes or truncated conical shapes or a combination of bell shape and/or conical shape may be made. In the alternative, the platen 68 may be fixed and the image plane varied along the axis 70 by varying the imaging optics of the laser 74 itself.

In an illustrative example of the ablation process, the image plane was coplanar with the top surface of the polymeric material 64. As the laser was fired, the platen 68 was moved up to shorten the distance between the laser and the polymeric material 64 along the optical path defined by axis 70. While there is no limitation, generally, with respect to the number of shots fired and the distance the platen 68 is moved, a typical example often includes about 300 shots fired by the laser and platen movement of about 60 microns.

A laser source 74 which may be used to create flow features in the polymeric material 64 to form the nozzle plates 10 using the above described masks may be selected from an $F_2$, ArF, KrCl, KrF, or XeCl excimer or a frequency multiplied YAG laser. Laser ablation of the polymeric material 64 is achieved at a power of from about 100 millijoules per centimeter squared to about 5,000 millijoules per centimeter squared, preferably from about 150 to about 1,500 millijoules per centimeter squared, and most preferably from about 700 to about 900 millijoules per centimeter squared including all ranges subsumed therein. During the laser ablation process, a laser beam 72 having a wavelength of from about 150 nanometers to about 400 nanometers and most preferably about 248 nanometers is applied in pulses lasting from about one nanosecond to about 200 nanoseconds and most preferably about 20 nanoseconds.

Specific flow features of the nozzle plates 10 are formed by applying a predetermined number of pulses of the laser beam through the mask 76. Many energy pulses may be required in those portions of the polymeric material from which a greater cross-sectional depth of material is removed, such as the nozzles holes, and fewer energy pulses may be required in those portions of the polymeric material which require only a portion of the material be removed from the cross-sectional depth of the material, such as the ink chambers 12 and ink supply channels 14.

Figure 9:
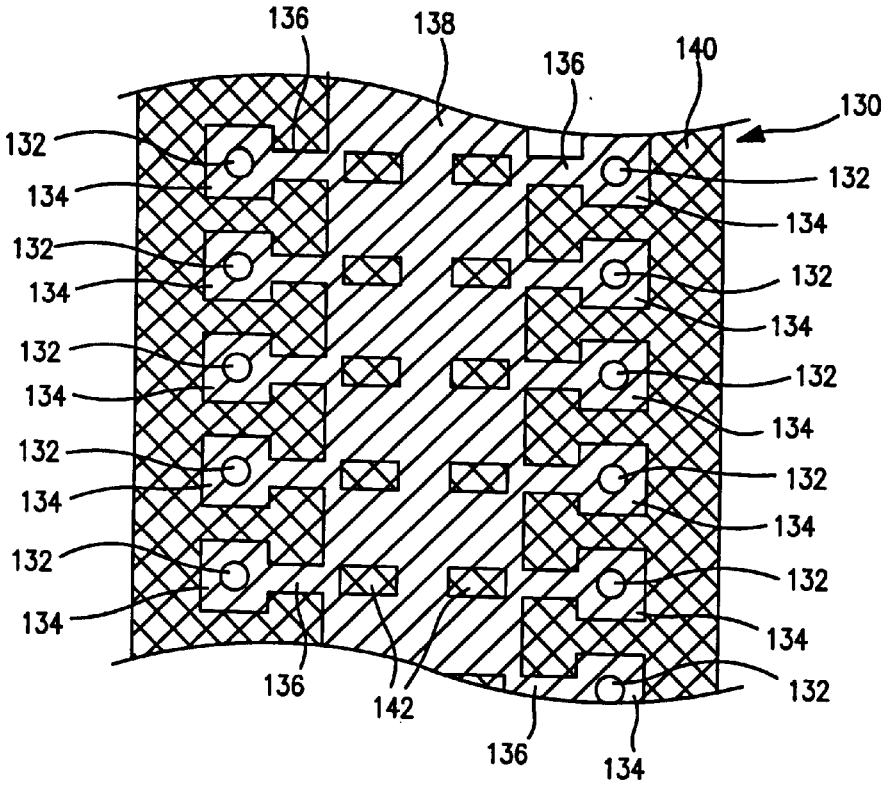
FIGS. 9 and 10 are plan views of portions of masks which may be used to form nozzle plates according to the invention.
Figure 10:
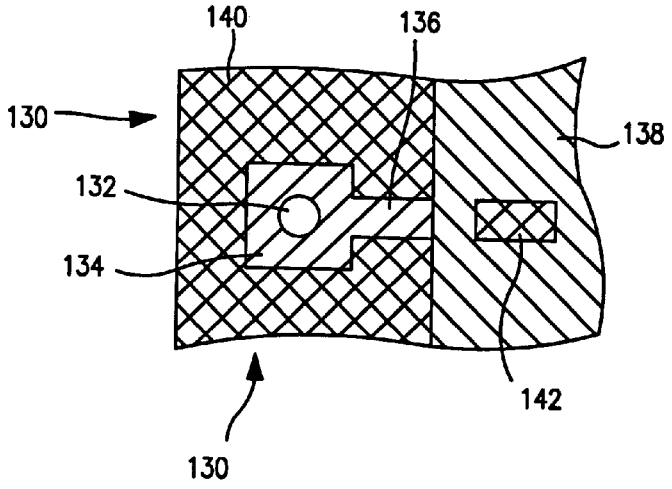

Multiple masks 76 in combination with laser beam defocusing techniques may be used to produce a variety of nozzle plate flow feature designs. In the alternative, a single mask 76 having a varying opacity from transparent to opaque may be used to reduce the manufacturing steps and time required to produce the nozzle plates. A particularly preferred mask is illustrated in FIGS. 9 and 10. In FIG. 10, mask 130 contains transparent regions 132 which are used to ablate features such as nozzle holes in a polymeric material 64. Surrounding the transparent regions are semi-transparent regions 134 which are used to produce the ink chambers in the nozzle plate. Likewise, the supply channels are formed by semi-transparent regions 136 and the ink supply region is formed by semi-transparent region 138 which have either the same or more opacity than the ink chamber regions 134. The peripheral areas 140 of the mask 130 around the flow features indicated by the cross-hatched regions and areas 142 indicated by the cross-hatched regions in the center portion semitransparent region 138 are substantially opaque so that little or no ablation of the polymeric material takes place outside of the ink chamber region 134, supply channel region 136 and ink supply region 138.

The semi-transparent and opaque regions of the mask 130 may be made by varying the shading of the mask by increasing the number of opaque lines and thus the gray scale shading of the mask in the regions where lower opacity is desired. Any of the methods known to those of skill in the art may be used to prepare the mask have semi-transparent and opaque regions. For example, the lines may be coated or printed onto the mask material or web made from metal or other material resistant to ablation by laser radiation.

Masks are typically made of quartz or other materials capable of transmitting uv light including calcium fluoride, magnesium fluoride and glass. The opaque regions may be formed from any metal capable of absorbing and/or reflecting UV light at the requisite wavelength, or it can be formed from a dielectric such as a metal oxide.

The side boundaries of the flow features ablated in the polymeric material are defined by the mask 130, which allows essentially full laser beam power to pass through holes or transparent regions of the mask and inhibits or reduces the laser beam energy reaching the polymeric material in the opaque and semi-transparent regions of the mask, respectively.

During the laser ablation process debris is formed from the polymeric material which, if not removed, may affect the performance of the nozzle plate. However, since the ablated side of the polymeric material contains a sacrificial layer coated over the adhesive layer, any debris that forms lands on the sacrificial layer rather than on the underlying adhesive layer. After forming the nozzles, the sacrificial layer is removed.

The sacrificial layer is preferably a water soluble polymeric material, preferably polyvinyl alcohol, which may be removed by directing jets of water at the sacrificial layer until substantially all of the sacrificial layer has been removed from the adhesive layer. Since the sacrificial layer contains the debris, removal of the sacrificial will carry away the debris adhered to it. In this manner the polymeric material is freed of the debris which may cause structural or operational problems.

Having described the invention and preferred embodiments thereof, it will be recognized that the invention is capable of numerous modifications, rearrangements and substitutions of parts by those of ordinary skill without departing from the spirit and scope of the invention as defined by the appended claims.

What is claimed is:

1. A flow feature structure for an ink jet printer comprising a polymeric nozzle plate having a nozzle plate thickness, the nozzle plate containing a plurality of ink chambers, each ink chamber containing a nozzle hole in fluid communication therewith, a plurality of ink channels each having a channel width and an ink channel inlet for providing ink flow from an ink supply region to one each of the ink chambers and an air bubble interrupter device having a width dimension perpendicular to a flow axis through the ink channel, the width dimension being from about 0.5 to about 1.2 times the ink channel width and the interrupter device being disposed adjacent each of the ink channels and spaced from the ink channel inlet a distance of from about 0.5 to about 1.2 times the ink channel width.

2. The flow feature structure of claim 1 wherein the air bubble interrupter device has a height dimension ranging from about 0.1 to about 0.8 times the thickness of the nozzle plate.

3. The flow feature structure of claim 1 wherein the air bubble interrupter device has a length ranging from about 1 to about 1.5 times the ink channel width.

4. The flow feature structure of claim 1 wherein the air bubble interrupter device is disposed between the ink channel inlet and an ink via in a semiconductor chip to which the nozzle plate is attached.

5. An ink jet printhead comprising a semiconductor substrate containing a plurality of heater resistors, a nozzle plate attached to the semiconductor substrate using an adhesive, the nozzle plate having a thickness for containing ink flow features therein for use in the absence of a separate thick film layer, the flow features including a plurality of ink chambers, each ink chamber containing a nozzle hole in fluid communication therewith, a plurality of ink channels each having a channel width and an ink channel inlet for providing ink flow from an ink supply region to one each of the ink chambers and an air bubble interrupter device having a width dimension perpendicular to a flow axis through the ink channel, the width dimension being from about 0.5 to about 1.2 times the ink channel width and the interrupter device being disposed adjacent each of the ink channels and spaced from the ink channel inlet a distance of from about 0.5 to about 1.2 times the ink channel width.

6. The printhead of claim 5 wherein the air bubble interrupter device has a height dimension ranging from about 0.1 to about 0.8 times the thickness of the nozzle plate.

7. The printhead of claim 5 wherein the air bubble interrupter device has a length ranging from about 1 to about 1.5 times the ink channel width.

8. The printhead of claim 5 wherein the air bubble interrupter device is disposed between the ink channel inlet and an ink via in a semiconductor chip to which the nozzle plate is attached.

9. The printhead of claim 5 further comprising a photoresist layer attached to a least a portion of the semiconductor substrate between the semiconductor substrate and the nozzle plate.

10. The printhead of claim 9 wherein the air bubble interrupter device is attached to the photoresist layer.

11. The printhead of claim 9 wherein the air bubble interrupter device is spaced from the semiconductor substrate.

12. A method for improving ink jet printing comprising, laser ablating a polymeric material having a thickness sufficient to provide a nozzle plate for an ink jet printhead containing a plurality of nozzle holes, ink chambers and ink flow channels therein, laser ablating an air bubble breaker in the polymeric material adjacent each inlet of each ink flow channel leading to an ink chamber associated with a nozzle hole in the nozzle plate, the bubble breaker having dimensions and being spaced from the inlets of the ink flow channels a distance of from about 0.5 to about 1.2 times an ink channel width to substantially reduce the size of air bubbles which may form or accumulate in ink supply regions of the nozzle plate to a size sufficient to urge the air bubbles away from the ink flow channel inlets, and attaching the polymeric material to a semiconductor substrate to provide an ink jet printhead having improved ink flow performance.

13. The method of claim 12 wherein the air bubble breaker has a height dimension ranging from about 0.1 to about 0.8 times the thickness of the nozzle plate.

14. The method of claim 12 wherein the air bubble breaker has a length ranging from about 1 to about 1.5 times the ink channel width.

15. The method of claim 12 wherein the air bubble breaker is disposed between the ink channel inlet and an ink via in a semiconductor chip to which the nozzle plate is attached.

16. The method of claim 12 further comprising applying a photoresist layer to the semiconductor substrate prior to attaching the polymeric material to the semiconductor substrate.

17. The method of claim 16 further comprising patterning the photoresist layer so that there is a gap between the bubble breaker and the semiconductor substrate to which the polymeric material is attached.

* * * * *